US007333067B2

(12) United States Patent
Hung et al.

(10) Patent No.: US 7,333,067 B2
(45) Date of Patent: Feb. 19, 2008

(54) MULTI-BAND ANTENNA WITH WIDE BANDWIDTH

(75) Inventors: Chen-Ta Hung, Tu-chen (TW); Lung-Sheng Tai, Tu-Chen (TW); Hsien Chu Lin, Tu-chen (TW); Yun-Lung Ke, Tu-chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 226 days.

(21) Appl. No.: 11/026,601

(22) Filed: Dec. 30, 2004

(65) Prior Publication Data

US 2005/0259024 A1 Nov. 24, 2005

(30) Foreign Application Priority Data

May 24, 2004 (TW) ..... 93114591 A

(51) Int. Cl.
*H01Q 13/10* (2006.01)

(52) U.S. Cl. ..... 343/770; 343/700 MS; 343/702

(58) Field of Classification Search ..... 343/700 MS, 343/702, 767, 770, 829, 846
See application file for complete search history.

(56) References Cited

U.S. PATENT DOCUMENTS

| | | | | |
|---|---|---|---|---|
| 6,160,513 | A * | 12/2000 | Davidson et al. | 343/700 MS |
| 6,166,694 | A | 12/2000 | Ying | |
| 6,218,997 | B1 * | 4/2001 | Lindenmeier et al. | 343/725 |
| 6,343,208 | B1 | 1/2002 | Ying | |
| 7,046,199 | B2 * | 5/2006 | Montgomery et al. | 343/700 MS |
| 2004/0169611 | A1 * | 9/2004 | Korva | 343/770 |

* cited by examiner

*Primary Examiner*—Tho Phan
(74) *Attorney, Agent, or Firm*—Wei Te Chung

(57) ABSTRACT

A multi-band antenna (100) used in wireless communications includes a first radiating patch (20) arranged in a first plane and extending in a first direction, a second radiating patch (22) arranged in the first plane and extending in a second direction different from the first direction, a grounding portion (1) arranged in second plane parallel to the first plane, and an inverted F-shaped connecting portion (3) connecting the first and the second radiating patches and the grounding portion. The radiating patches define a plurality of slots (201, 202) for increasing a bandwidth of the antenna. The connecting portion defines a rectangular slot (35) for adjusting an impedance matching of the antenna.

17 Claims, 9 Drawing Sheets

MULTI-BAND ANTENNA WITH WIDE BANDWIDTH

BACKGROUND OF THE INVENTION

1. Field of the Invention

The present invention relates generally to an antenna, and more particularly to a multi-band antenna used in an electronic device.

2. Description of the Prior Art

In recent years, portable wireless communication devices are becoming increasingly popular. For the design of the wireless communication device, an antenna used with it for transmitting and receiving electromagnetic waves is an important factor should be taken into account. The antenna may be mounted out of or in the device. In general use, the antenna is built-in arranged to save space and increase convenience. Considering the miniaturization trend of the wireless communication devices, the size of the antenna should be accompanylingly reduced in order to be assembled in the limit space of the communication device.

Moreover, among present wireless technologies, Bluetooth running in 2.4 GHz, IEEE 802.11b/g running in 2.4 GHz and IEEE 802.11a running in 5 GHz are prevailing and dominant. In response to the wide applications of the frequency, there is an increasing demand to make one communication device to support two or more frequencies.

To make the miniaturized antenna supporting two or more working frequencies becomes a hot R&D issue. Many antennas have been developed in prior arts to address the issue, such as microstrip antennas, antennas with high dielectric constant, planar inverted-F antennas, combinations of loop antenna and slot antenna, small size patch antennas and the like.

A multi-band antenna embedded within a radio communication device is disclosed in U.S. Pat. No. 6,166,694. The conventional antenna comprises a dielectric substrate 320, two spiral arms 305, 310 printed on the dielectric substrate 320 and respectively tuned to a lower and a higher frequency bands and a matching bridge 330 connected to the spiral arms 305, 310. Referring to FIG. 5 of this prior art, a loading resistor 560 is attached to the matching bridge 330 for enhancing a bandwidth of the antenna. However, the dielectric substrate of the antenna will introduce insertion loss, which adversely affects the antenna gain. Additionally, though adding the loading resistor 560 can enhancing the bandwidth of the lower and the higher frequency bands, the bandwidth is still not wide enough, which restrains the application of the antenna.

Hence, in this art, a multi-band antenna with wide bandwidth to overcome the above-mentioned disadvantages of the prior art will be described in detail in the following embodiment.

BRIEF SUMMARY OF THE INVENTION

A primary object, therefore, of the present invention is to provide a multi-band antenna with wide bandwidth and compact configuration, and with easily tuned bandwidth and impedance matching.

In order to implement the above object and overcomes the above-identified deficiencies in the prior art, the multi-band antenna comprises a first radiating patch arranged in a first plane and extending in a first direction, a second radiating patch arranged in the first plane and extending in a second direction different from the first direction, a grounding portion arranged in second plane parallel to the first plane, and an inverted F-shaped connecting portion arranged in a third plane perpendicular to the first plane and connecting the first and the second radiating patches and the grounding portion. The radiating patches define a plurality of slots for increasing a bandwidth of the antenna. The connecting portion defines a rectangular slot for adjusting an impedance matching of the antenna.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
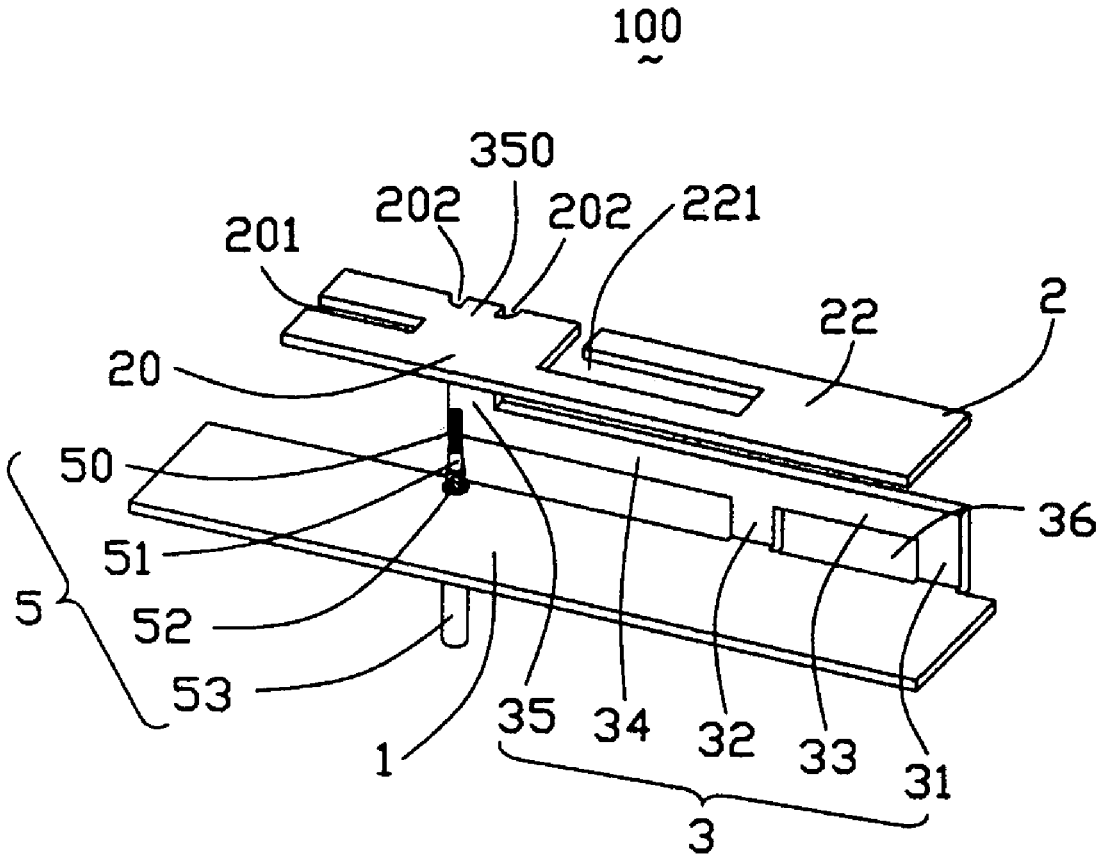
FIG. 1 is a perspective view of a multi-band antenna in accordance with the present invention.

Referring to FIG. 1, a multi-band antenna 100 according to the present invention is made of metal sheet and comprises a grounding portion 1 arranged in a first plane, a radiating portion 2 arranged in a second plane parallel to the first plane and a connecting portion 3 arranged in a third plane perpendicular to the first plane and connecting the grounding portion 1 and the radiating portion 2. A feeder cable 5 is provided for feeding the antenna 100.

The connecting portion 3 is substantially inverted F-shaped and comprises a first, a second, a third, a fourth and a fifth connecting sections 31, 32, 33, 34 and 35. The first and the second connecting sections 31, 32 upwardly and vertically extend from a same side of the grounding portion 1. The third connecting section 33 connects with the first and the second connecting sections 31, 32 and is parallel to the grounding portion 1. The fourth connecting section 34 is aligned with the third connecting section 33 and extends from an end of the third connecting section 32. The fifth connecting section 35 upwardly and vertically extends from an end of the fourth connecting section 34 and terminates to the radiating portion 2. The fifth connecting section 35 and the radiating portion 2 form a conjunction 350. The first, the second and the third connecting sections 31, 32 and 33 together form an n-shaped configuration with a rectangular slot 36 defining therein which is provided for tuning an input impedance of the antenna 100 so as to realize impedance matching between the antenna 100 and the feeder cable 5.

Figure 2:
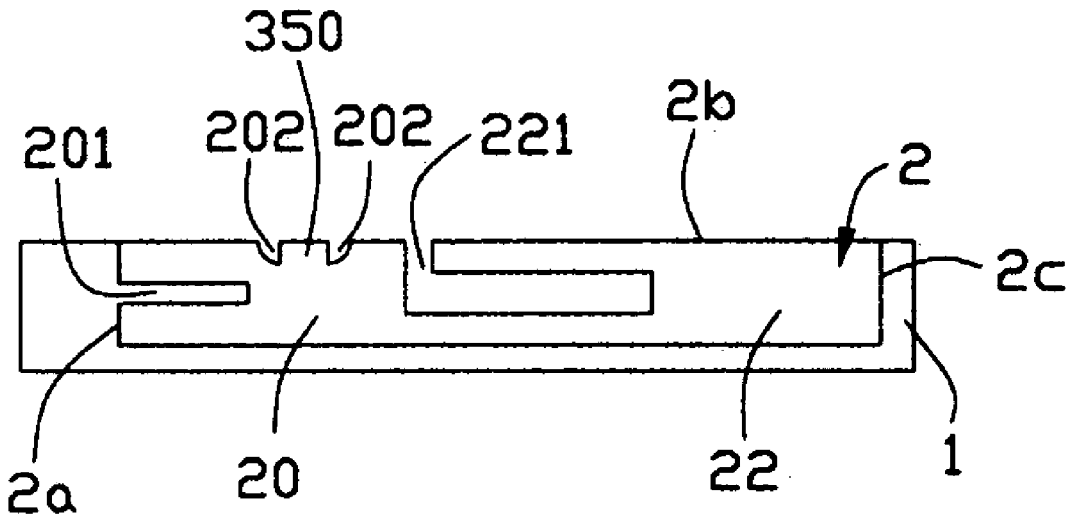
FIG. 2 is a top view of the multi-band antenna in accordance with the present invention.

The radiating portion 2 is formed into a substantially rectangular shape and comprises a first radiating patch 20 and a second radiating patch 22 extending in opposite directions from the conjunction 350. The first and the second radiating patches 20, 22 have the same width and different lengths. As best shown in FIG. 2, the radiating portion 2 has a first edge 2*a*, a second edge 2*b* adjacent and perpendicular to the first edge 2*a* and a third edge 2*c* adjacent to the second edge 2*b* and opposite to and parallel to the first edge 2*a*. The first radiating patch 20 defines a first elongated slot 201 inwardly extending from the first edge 2*a*. An open end of the first slot 201 is arranged on a central position of a width of the first edge 2*a* and a close end of the first slot 201 is adjacent to the conjunction 350. A width of the first elongated slot 201 is much narrower than that of the first radiating patch 20. The first and the second radiating patches 20, 22 respectively define a second arc slot 202 inwardly extending from the second edge 2*b* and positioned at two sides of the conjunction 350. The pair of arc slots 202 are both formed in configuration of a quarter of a circle and are arranged at an interval of a semidiameter of said circle. The semidiameter of the circle is much smaller than the width of the radiating portion 2. The second radiating patch 22 further defines a third L-shaped slot 221 adjacent to the conjunction 350. The L-shaped slot 221 extends from the second edge 2*b* and faces to the third edge 2*c*. The arc slots 202 are arranged between the elongated slot 201 and the L-shaped slot 221.

The feeder cable 5 is a coaxial cable and successively comprises an inner conductor 50, an inner insulator 51, an outer conductor 52 and an outer insulator 53. A feeder point is arranged on the fifth connection section 35. The inner conductor 50 is electrically connected with the feeder point. The outer conductor 52 is electrically connected with the grounding portion 1.

The first radiating patch 20, the connecting portion 3, the feeder cable 5 and the grounding portion 1 corporately form a first inverted-F antenna operating at a higher frequency bands of about 5.2 GHz and 5.75 GHz. The second radiating patch 22, the connecting portion 3, the feeder cable 5 and the grounding portion 1 corporately form a second inverted-F antenna operating at a lower frequency band of about 2.4 GHz. Defining the first slot 201 and the second slots 202 can increase the bandwidth of the first inverted-F antenna. Defining the third slot 221 helps decrease the dimension of the second inverted-F antenna.

Figure 3:
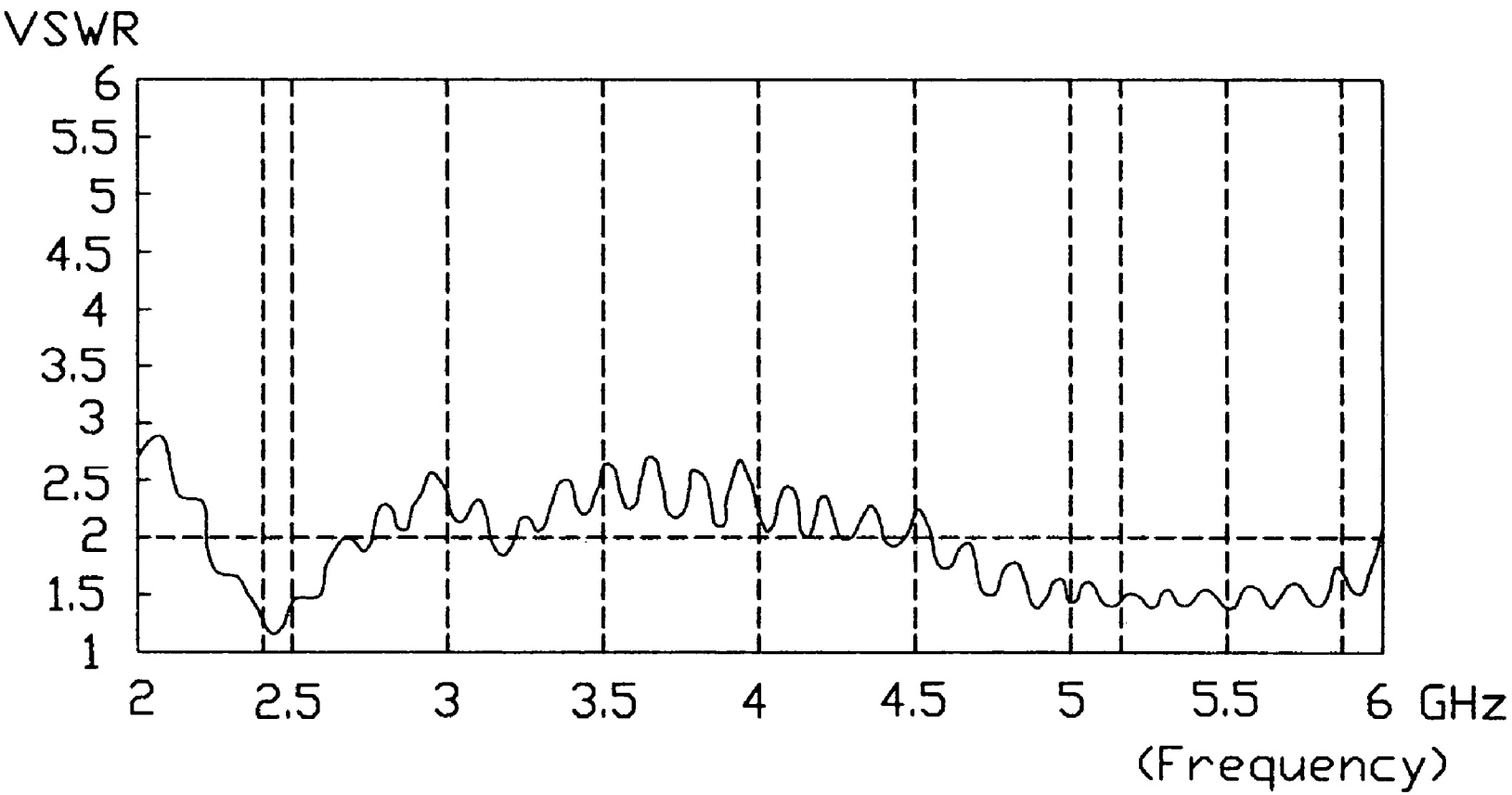
FIG. 3 is a test chart recording of Voltage Standing Wave Ratio (VSWR) of the dual-band antenna as a function of frequency.
Figure 4:
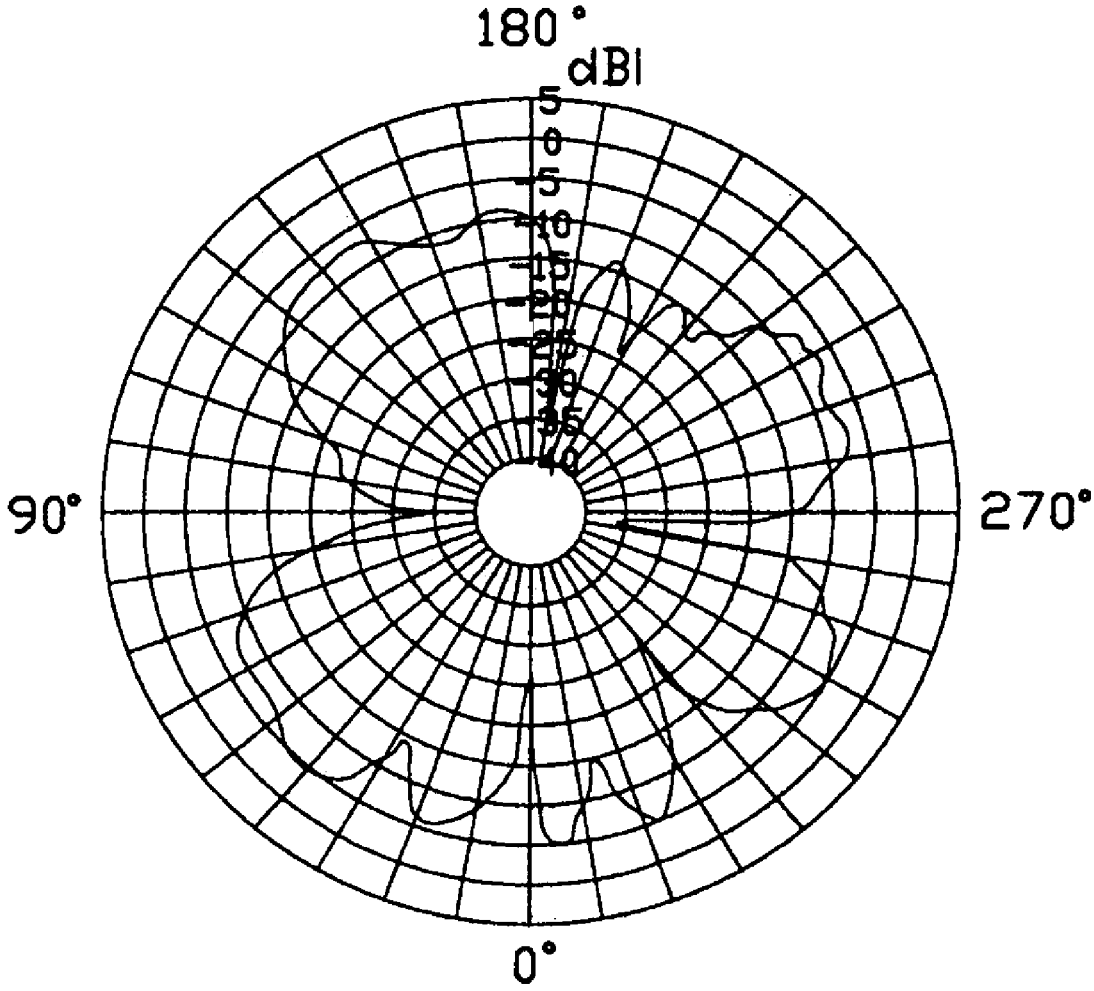
FIG. 4 is a horizontally polarized principle plane radiation pattern of the antenna operating at the resonant frequency of 2.45 GHz.
Figure 5:
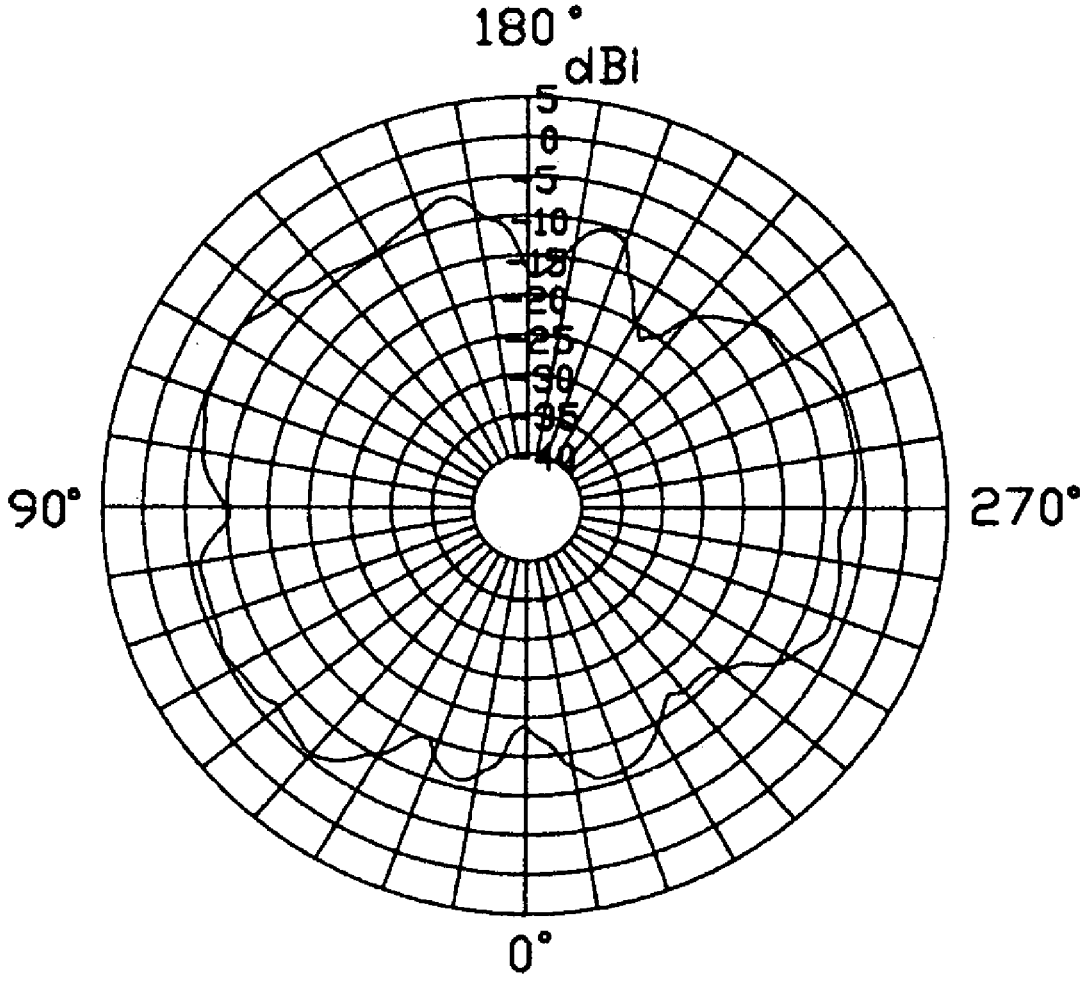
FIG. 5 is a vertically polarized principle plane radiation pattern of the antenna operating at the resonant frequency of 2.45 GHz.
Figure 6:
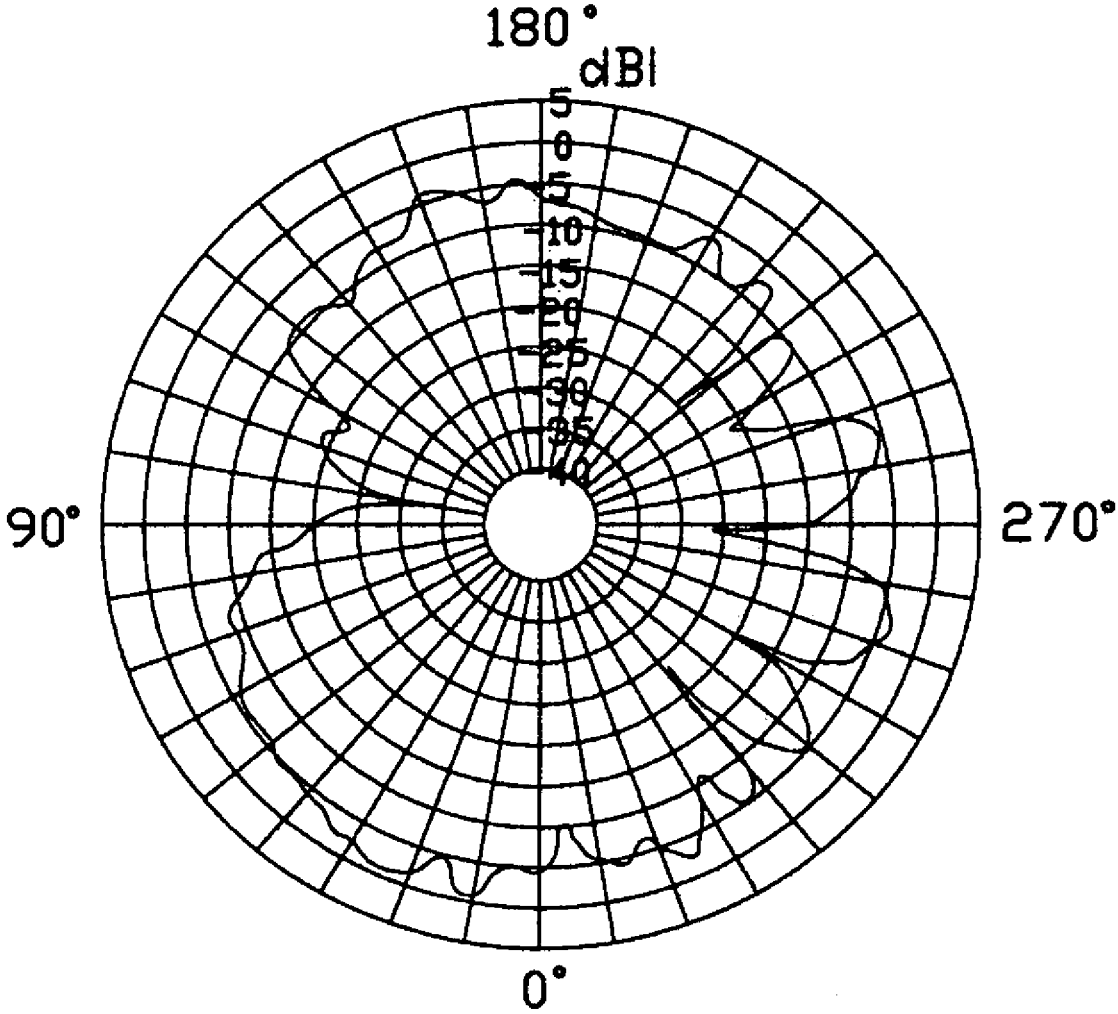
FIG. 6 is a horizontally polarized principle plane radiation pattern of the antenna operating at the resonant frequency of 5.25 GHz.
Figure 7:
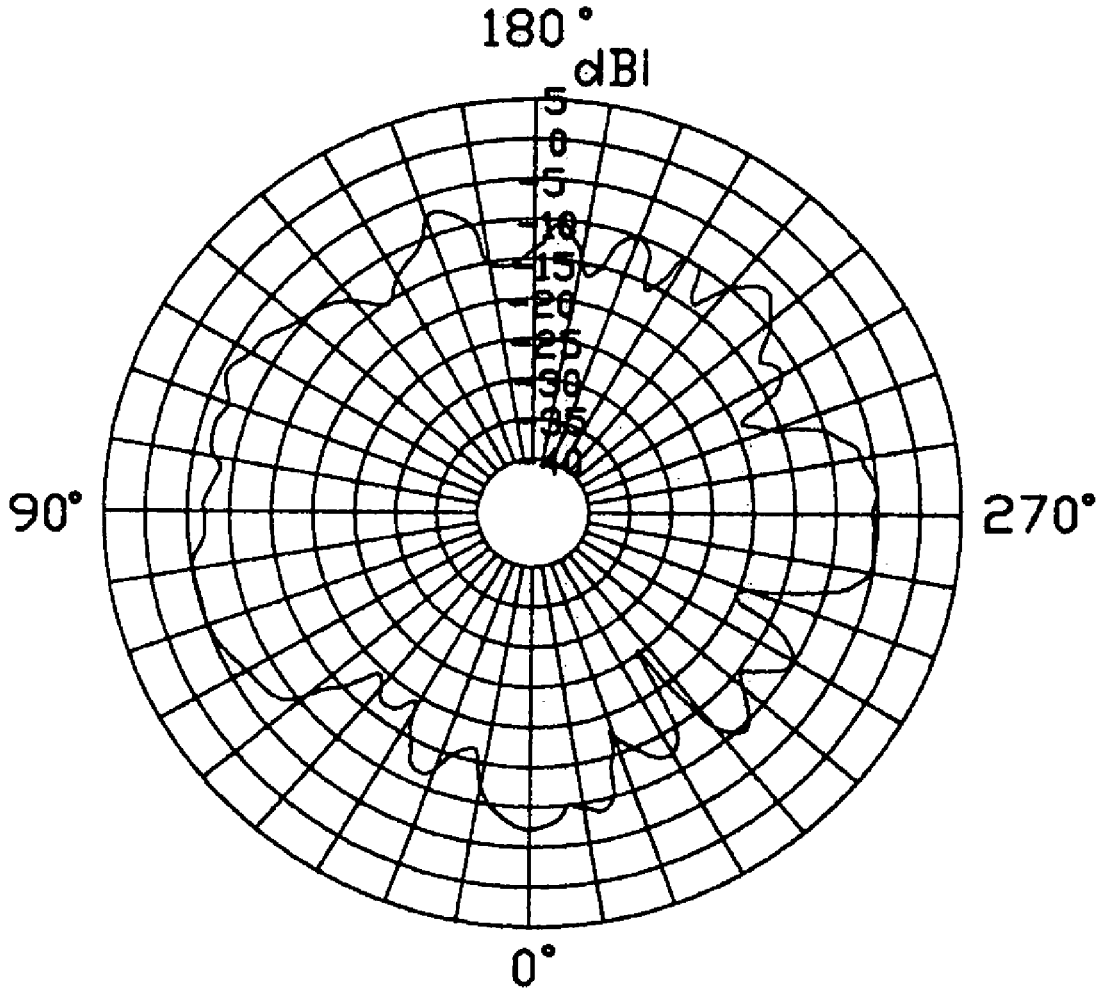
FIG. 7 is a vertically polarized principle plane radiation pattern of the antenna operating at the resonant frequency of 5.25 GHz.
Figure 8:
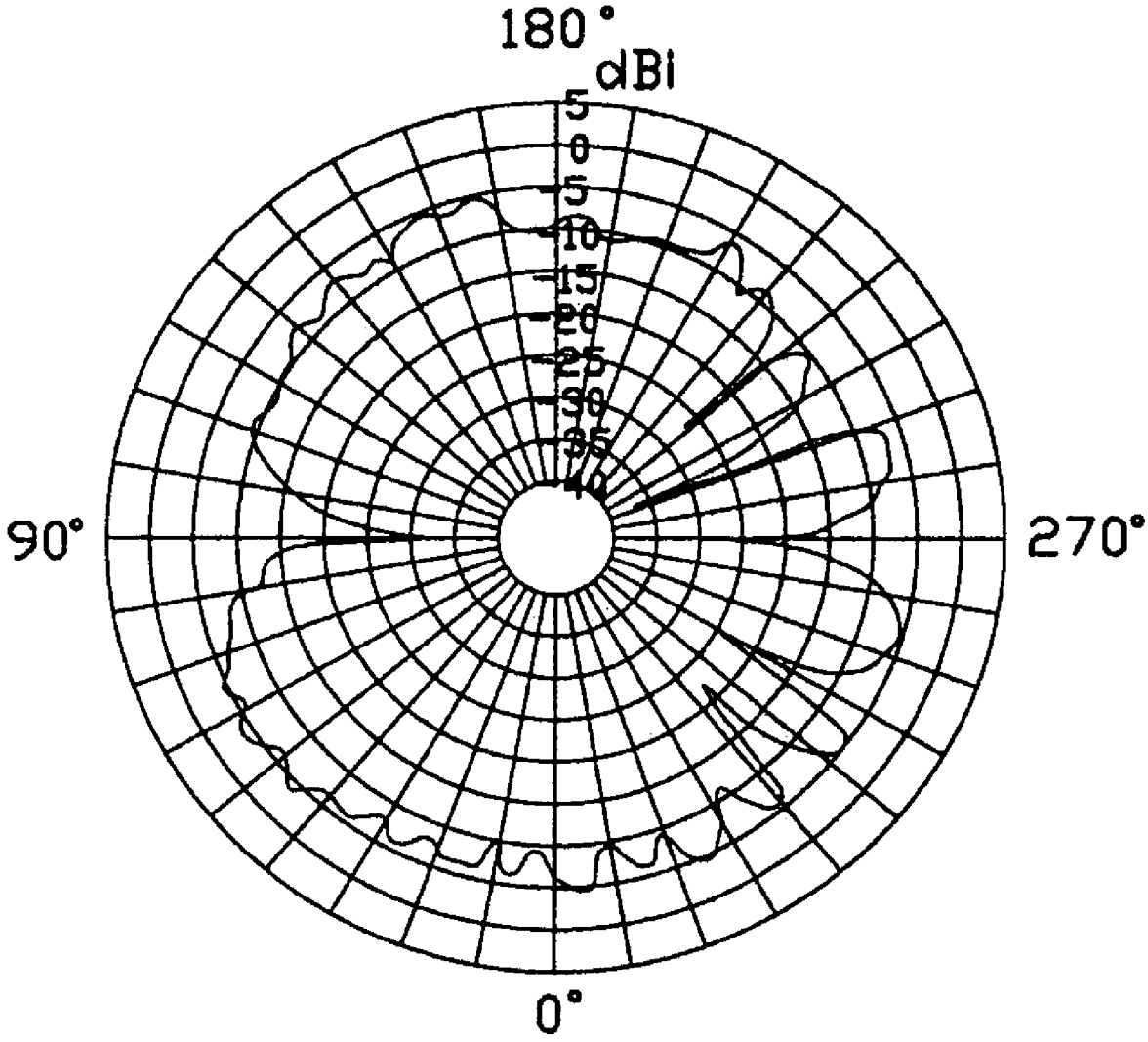
FIG. 8 is a horizontally polarized principle plane radiation pattern of the antenna operating at the resonant frequency of 5.598 GHz.
Figure 9:
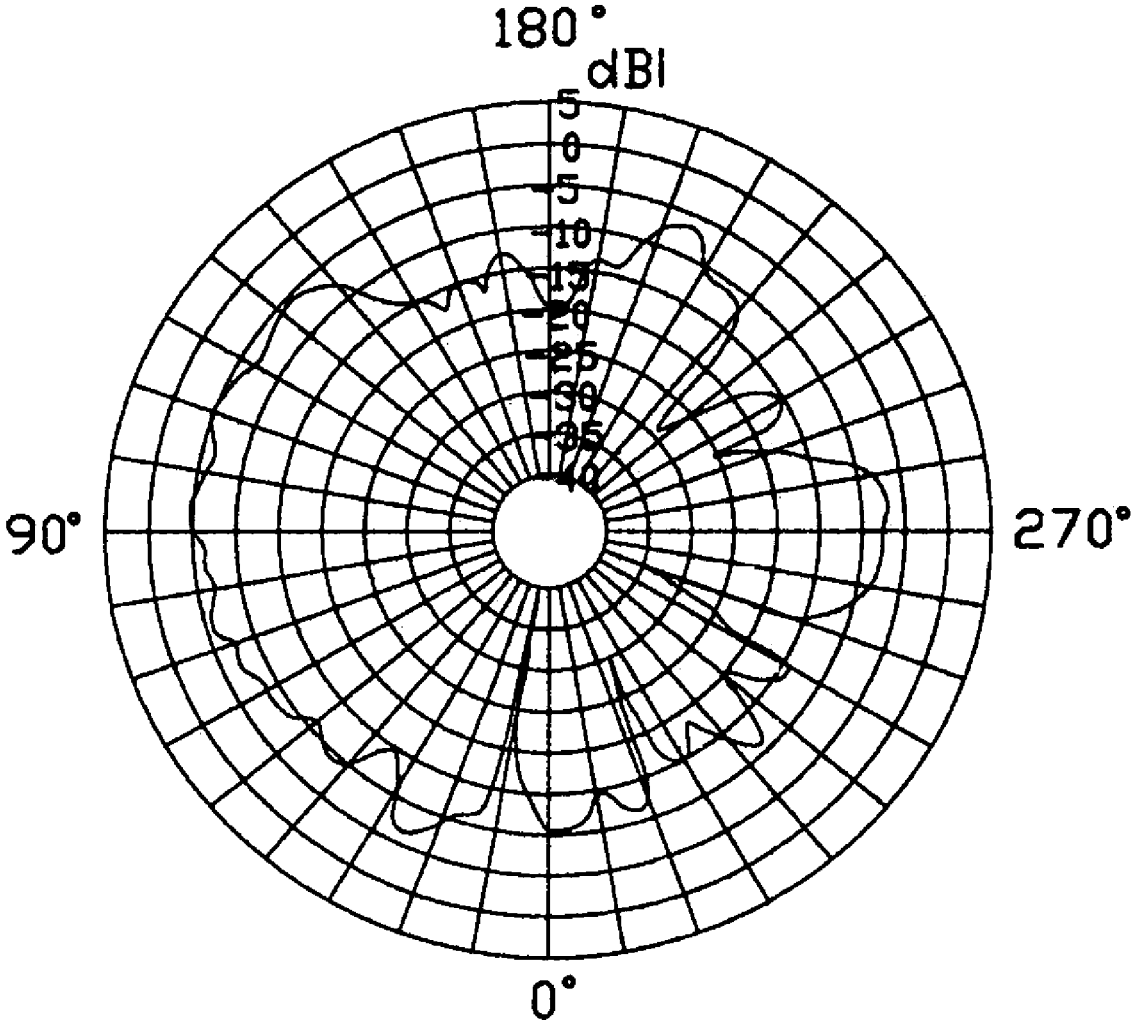
FIG. 9 is a vertically polarized principle plane radiation pattern of the antenna operating at the resonant frequency of 5.598 GHz.

In terms of this preferred embodiment, the performance of the antenna 100 is excellent. In order to illustrate the effectiveness of the present invention, FIG. 3 sets forth a test chart recording of Voltage Standing Wave Ratio (VSWR) of the dual-band antenna 100 as a function of frequency. Note that VSWR drops below the desirable maximum value "2" in the 2.4-2.5 GHz frequency band which covers the bandwidth of wireless communications under Bluetooth and IEEE 802.11b/g standard, and 5.15-5.85 GHz, indicating a wide bandwidth of 700 MHz, which covers the bandwidth of wireless communications under IEEE 802.11a standard.

FIGS. 4-9 show the horizontally polarized and vertically polarized principle plane radiation patterns of the antenna 100 operating at the resonant frequency of 2.45 GHz, 5.25 GHz and 5.598 GHz. Note that each radiation pattern of the multi-band antenna 100 is close to corresponding optimal radiation pattern and there is no obvious radiating blind area, conforming to the practical use conditions of an antenna.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A built-in antenna used with an electronic device, comprising:

a grounding portion;

a radiating portion arranged in a lengthwise direction and comprising adjacent first and second edges, the radiating portion defining at least two slots each having an open end respectively arranged on said first and second edges; and a connecting portion connecting the radiating portion and the grounding portion, wherein the connecting portion comprises a first, a second and a third connecting sections corporately forming an n-shape with a slot therein for using to turn an impedance matching of the antenna.

2. The built-in antenna as claimed in claim 1, wherein the radiating portion comprises a first and a second radiating patches, the first radiating patch defines a first elongated slot inwardly extending from the first edge thereof for increasing a bandwidth of the antenna.

3. The built-in antenna as claimed in claim 2, wherein the first slot straightly extends in said lengthwise direction, a width of the first slot being much narrower than that of the radiating portion.

4. The built-in antenna as claimed in claim 3, wherein the radiating portion defines a second slot inwardly extending from a second edge thereof perpendicular to the First edge for inercasing the bandwidth of the antenna.

5. The built-in antenna as claimed in claim 4, wherein the second slot comprises at least an arc-shaped slot defined in one of the first and the second radiating patches.

6. The built-in antenna as claimed in claim 5, wherein the second radiating patch defines a substantially L-shaped third slot having an opening on said second edge of the radiating portion and extending to a third edge of the radiating portion parallel to the first edge.

7. The built-in antenna as claimed in claim 1, wherein the radiating portion is arranged in a first plane parallel to the grounding portion and the connecting portion is arranged in another plane perpendicular to the grounding portion, the connecting portion being formed of metal.

8. The built-in antenna as claimed in claim 7, wherein the radiating portion is substantially rectangular shaped with perpendicular first and second edges, the slots extending from respective one of the edges and both in said lengthwise direction.

9. The antenna as claimed in claim 1, wherein said radiating portion is located on a first plane, the connecting portion is located on a second plane, and the grounding portion which is integrated with the radiating portion and the connecting portion is located on a third plane parallel to the first plane.

10. A built-in antenna used with an electronic device, comprising:

a grounding portion;

a radiating portion defining at least two slots having different shapes and different dimensions from each other so as to form multiple bands thereof;

a connecting portion connecting the radiating portion and the grounding portion; and a feeder cable comprising an inner conductor connected to the connecting portion and an outer conductor connected to the grounding portion to form a close loop together with the connecting portion and the grounding portion.

11. The antenna as claimed in claim 10, wherein said connection portion is located on a plane different from that of either one of said grounding portion and said radiating portion.

12. The antenna as claimed in claim 10, wherein said radiating portion comprises a first and a second radiating patches, the first radiating patch, the connecting portion and the grounding portion form a first inverted-F antenna to work at a first frequency, and the second radiating portion, the connecting potion and the grounding portion form a second inverted-F antenna to work at a second frequency different from the first frequency.

13. The antenna as claimed in claim 12, wherein said second radiating portion comprises a third L-shaped slot to decrease the dimension of the second inverted-F antenna and the two slots are all used to increase the band width of the first inverted-F antenna.

14. The antenna as claimed in claim 10, wherein the connecting portion is a single piece connected to the radiating portion only at a position between said at least two slots.

15. The antenna as claimed in claim 14, wherein said at least two slots include one straight slot and on L-shaped slot.

16. The antenna as claimed in claim 15, wherein the radiating portion essentially defines a slender rectangle having a long side and a short side of, and the straight slot defines an opening on the short side while the L-shaped slot defines another opening one the long side.

17. A built-in antenna used with an electronic device, comprising:

a grounding portion;

a radiating portion defining at least two slots having different shapes and different dimensions from each other so as to form multiple bands thereof;

a connecting portion connecting the radiating portion and the grounding portion; and the connecting portion is a single piece connected to the radiating portion only at a position between said at least two slots; wherein said at least two slots include one straight slot and one L-shaped slot; wherein the radiating portion essentially defines a slender rectangle having a long side and a short side of, and the straight slot defines an opening on the short side while the L-shaped slot defines another opening on the long side. to the grounding portion.

* * * * *